US009941644B1

(12) United States Patent
Liu et al.

(10) Patent No.: US 9,941,644 B1
(45) Date of Patent: Apr. 10, 2018

(54) POWER OUTLET DEVICE

(71) Applicant: CYBER POWER SYSTEMS, INC., Taipei (TW)

(72) Inventors: Yen-Nan Liu, Taipei (TW); Chang-Ming Lee, Taipei (TW)

(73) Assignee: CYBER POWER SYSTEMS, INC., Taipei (TW)

( * ) Notice: Subject to any disclaimer, the term of this patent is extended or adjusted under 35 U.S.C. 154(b) by 0 days.

(21) Appl. No.: 15/660,205

(22) Filed: Jul. 26, 2017

(30) Foreign Application Priority Data

Jun. 23, 2017 (TW) ..... 106120994 A

(51) Int. Cl.

| | |
|---|---|
| ***H01R 3/00*** | (2006.01) |
| ***H01R 13/717*** | (2006.01) |
| ***H01R 13/10*** | (2006.01) |
| *H01R 25/00* | (2006.01) |

(52) U.S. Cl.
CPC ..... *H01R 13/7175* (2013.01); *H01R 13/10* (2013.01); *H01R 25/003* (2013.01)

(58) Field of Classification Search
CPC ... H01R 13/10; H01R 13/7175; H01R 13/717
See application file for complete search history.

(56) References Cited

U.S. PATENT DOCUMENTS 3,895,225 A * 7/1975 Prior ..... F21S 8/00 362/95
5,277,620 A * 1/1994 Taylor ..... H01R 13/717 439/372
5,780,775 A * 7/1998 Yu ..... H01R 13/506 174/135
6,089,893 A * 7/2000 Yu ..... H01R 13/717 362/95
6,908,334 B2 * 6/2005 Huang ..... H01R 13/465 439/491
7,402,060 B1 * 7/2008 Buzil ..... H01R 13/70 362/95
7,726,825 B2 * 6/2010 Mandapat ..... H01R 25/003 361/118
8,187,024 B2 * 5/2012 Williams ..... H01R 13/717 439/488
8,393,747 B2 * 3/2013 Kevelos ..... H01H 13/83 362/551
2014/0187079 A1 * 7/2014 Zien ..... H01R 13/514 439/490

* cited by examiner

*Primary Examiner* — Briggitte R Hammond
(74) *Attorney, Agent, or Firm* — Bacon & Thomas, PLLC

(57) ABSTRACT

A power outlet device including a outer element, a light indicating element and a outlet module is provided. The outer element has a first portion and at least one second portion. The first portion is configured out of the second portion. At least one first through hole is configured in the second portion. The first portion and the second portion are opaque portions. The light indicating element has at least one lighting set corresponding to one second portion. Each lighting set has at least one lighting unit. Each lighting unit is configured in the inner periphery of each first through hole of the second portion. The light indicating element is configured in the outlet module, and the outer element is configured on the light indicating element. Wherein, each lighting unit is exposed from the corresponding first through hole.

15 Claims, 5 Drawing Sheets

110

120

POWER OUTLET DEVICE

BACKGROUND OF THE INVENTION

Field of the Invention

The present invention relates to a power outlet device, and more particularly, the present invention is relates to a power outlet device having function of light indication.

Description of Related Art

With the popularity of electrical products, various power outlet devices are also widely used. When the power outlet device is located in darkness room or an area of reduced visibility, it is difficult for users to determine the position of the socket unit or each prong-hole located in the power outlet device. Thus, it is an important subject how to determine the position of the socket unit or each prong-hole located in the power outlet device when the user is in darkness room or an area of reduced visibility.

SUMMARY OF THE INVENTION

Accordingly, an object of the present invention is to provide a power outlet device, which position of the socket unit or each prong-hole located in the power outlet device can be found easily in darkness room or an area of reduced visibility.

To achieve the foregoing and other objects, a power outlet device is provided. The power outlet device includes a outer element, a light indicating element and a outlet module. The outer element has a first portion and at least a second portion. The first portion is configured out of the second portion. At least one first through hole is configured in the second portion. Wherein, the first portion and the second portion are opaque portions. The light indicating element has at least one lighting set. Each lighting set is corresponding to each second portion. Each lighting set has at least one lighting unit. Each lighting unit is configured in the inner periphery of each first through hole of the second portion. The light indicating element is configured on the outlet module, and the outer element is configured on the light indicating element. Each lighting unit is exposed from the corresponding first through hole.

In one embodiment of the present invention, wherein the first through hole is a prong-hole, the first through hole is configured with a hole wall, and each lighting unit is configured at the hole wall of the first through hole.

In one embodiment of the present invention, wherein the outlet module has a accommodation space, and the light indicating element is configured in the accommodation space.

In one embodiment of the present invention, wherein the outer element further includes a outer surface and a inner surface, the first portion and the second portion are configured on at least one of the outer surface and the inner surface.

In one embodiment of the present invention, wherein the light indicating element further includes a board and multiple second through holes, the lighting set is configured in the board, the second through holes are corresponding to the first through holes for being configured in the board, and each lighting unit is configured around the corresponding second through hole.

In one embodiment of the present invention, wherein each lighting unit is protruded to the first through hole from the board.

In one embodiment of the present invention, wherein the projection area of each second through hole projected on the outer element is overlapped with at least a part of the corresponding first through hole.

In one embodiment of the present invention, wherein the outer element further includes at least a third portion, each third portion is corresponding to the second portion, each third portion is configured around the corresponding second portion, the third portion is a light transmission portion.

In one embodiment of the present invention, wherein the third portion is configured between the first portion and each second portion.

In one embodiment of the present invention, wherein the projection area of each third portion projected on the light indicating element is around the corresponding lighting set.

In one embodiment of the present invention, wherein the second portion is a socket region, and the first portion is a decorative region.

In one embodiment of the present invention, wherein the lighting unit is a light emitting diodes.

In one embodiment of the present invention, wherein the lighting unit is a ring light emitting structure.

In one embodiment of the present invention, wherein the shape of the lighting unit is similar to the shape of the first through hole.

In one embodiment of the present invention, wherein top portion of the lighting unit is a slope structure, the slope structure is tilted toward the inner edge of the lighting unit from the outer edge of the lighting unit.

BRIEF DESCRIPTION OF THE DRAWINGS

Other features and advantages of the present invention will become apparent in the following detailed description of the preferred embodiments with reference to the accompanying drawings, of which.

DESCRIPTION OF EMBODIMENTS

The characteristics, contents, advantages and achieved effects of the present disclosure will become more fully understood from the detailed description given herein below and the accompanying drawings which are given by way of illustration only, and thus are not limitative of the present disclosure.

As required, detailed embodiments are disclosed herein. It must be understood that the disclosed embodiments are merely exemplary of and may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Figure 1:
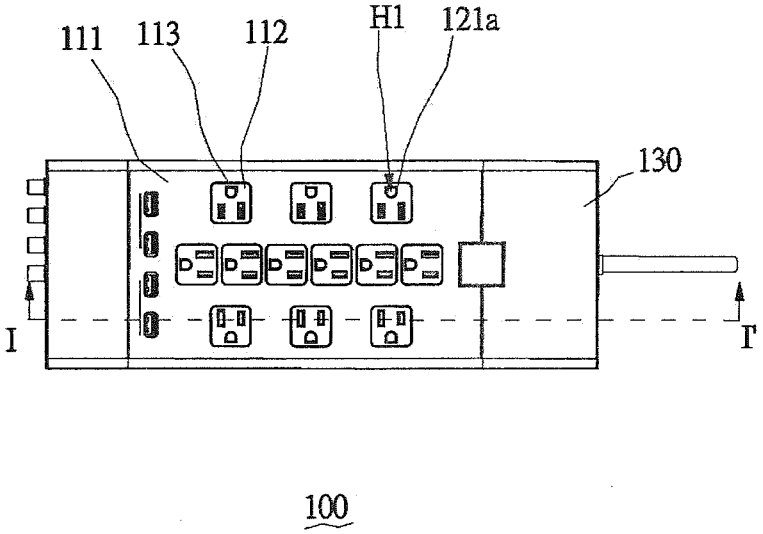
FIG. 1 is a schematic top view of a power outlet device according to one embodiment of the present invention.
Figure 2:
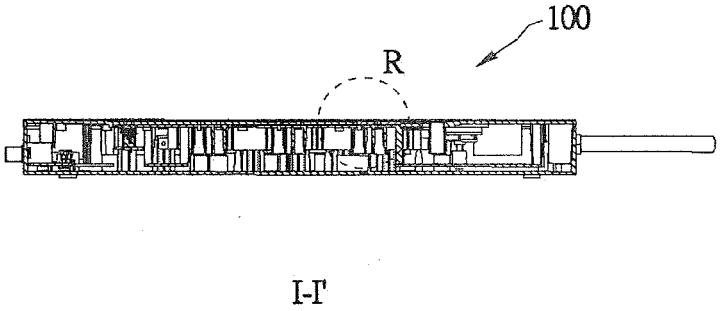
FIG. 2 is a schematic sectional view taken along I-I' line in FIG. 1.
Figure 3:
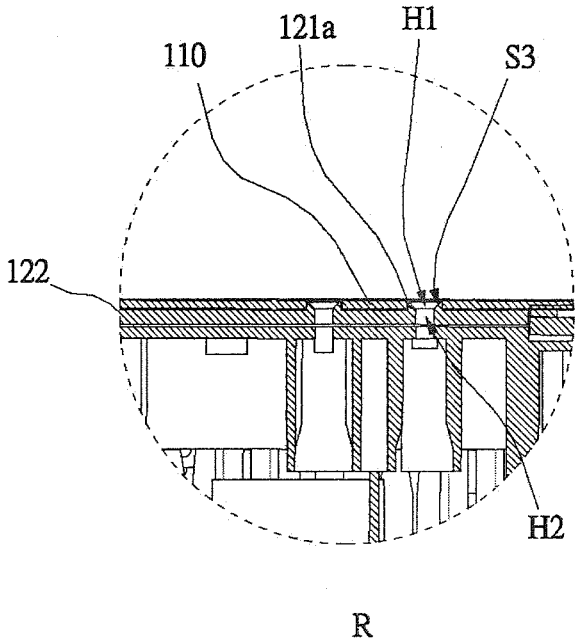
FIG. 3 is a schematic enlarged view taken of R region in FIG. 2.
Figure 4:
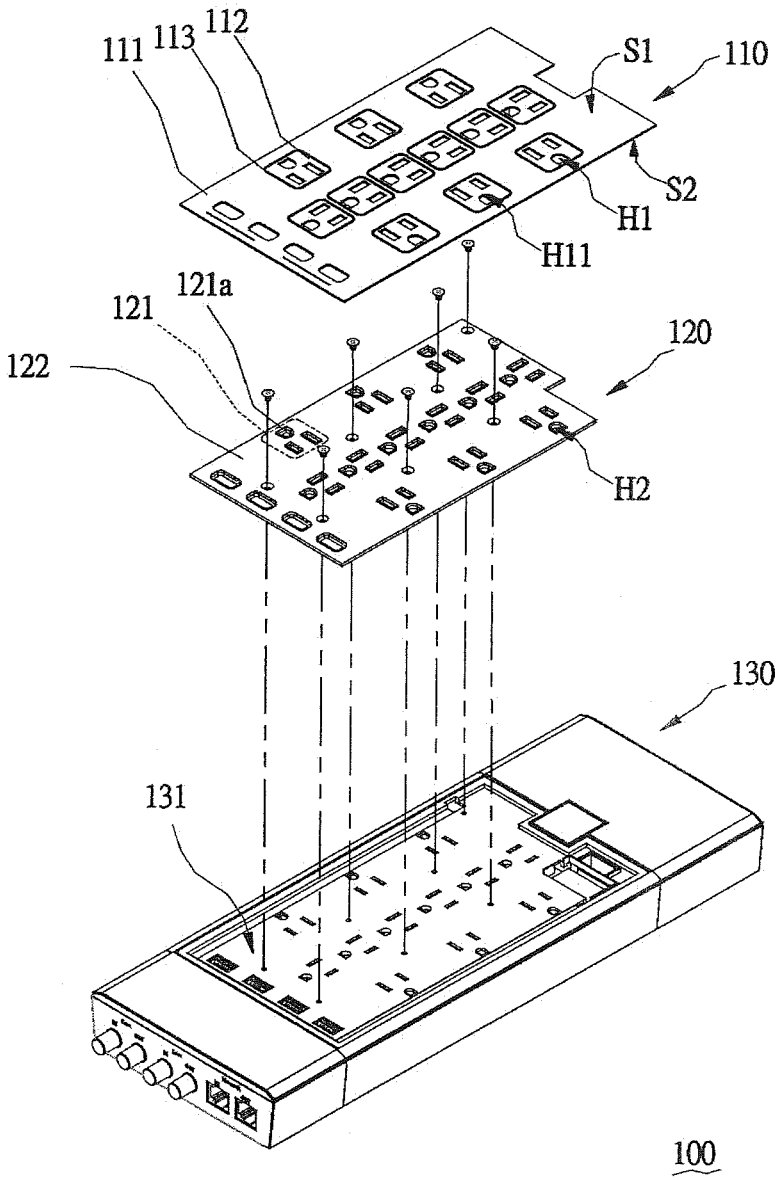
FIG. 4 is an exploded view of the power outlet device in FIG. 1.
Figure 5:
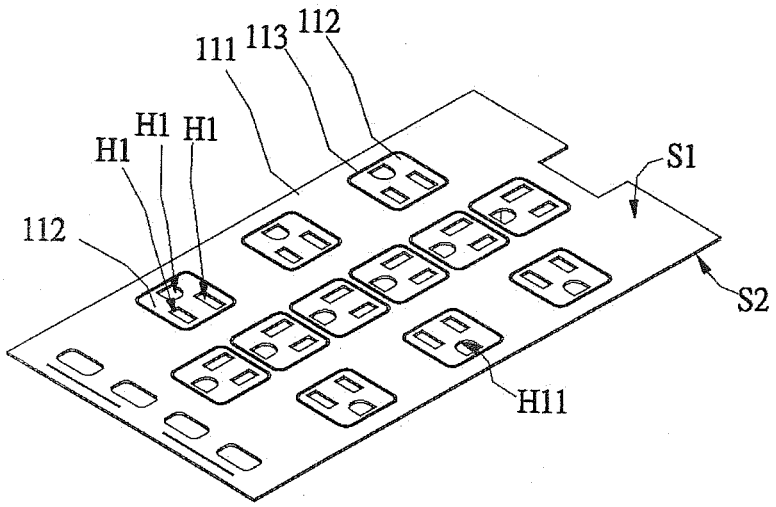
FIG. 5 is a schematic enlarged view of the outer element in FIG. 4.
Figure 6:
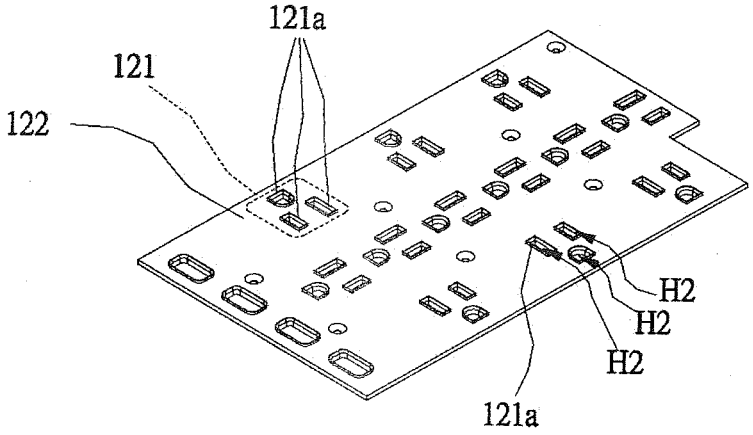
FIG. 6 is a schematic enlarged view of the light indicating element in FIG. 4.

FIG. 1 is a schematic top view of a power outlet device according to one embodiment of the present invention. FIG. 2 is a schematic sectional view taken along I-I' line in FIG. 1. FIG. 3 is a schematic enlarged view taken of R region in FIG. 2. FIG. 4 is an exploded view of the power outlet device in FIG. 1. FIG. 5 is a schematic enlarged view of the outer element in FIG. 4. FIG. 6 is a schematic enlarged view of the light indicating element in FIG. 4. Referring to FIG. 1, FIG. 2, FIG. 3, FIG. 4, FIG. 5 and FIG. 6, the power outlet device 100 of the present embodiment is a power outlet device with extension cord, for example. Certainly, in other preferred embodiment, the power outlet device 100 also can be configured in the wall, and the present invention will not be limited to this.

The power outlet device 100 of the present embodiment includes a outer element 110, a light indicating element 120 and a outlet module 130 mainly. Wherein, the outlet module 130 has a accommodation space 131, for example. The light indicating element 120 can be configured in accommodation space 131. In addition, the outer element 110 of the present embodiment is configured on light indicating element 120. In other words, in the present embodiment, the light indicating element 120 is configured between the outer element 110 and outlet module 130.

In addition, the outer element 110 of the present embodiment has a first portion 111 and at least a second portion 112, and the first portion 111 is configured out of the second portion 112. In other words, the second portion 112 is surrounded by the first portion 111. Wherein, the present embodiment is exemplified by applying multiple second portions 112. Each second portion 112 is, for example, a socket region. Herein, the socket region refers to the region where a plug of an electrical device can be inserted. Besides, the first portion 111 is, for example, a decorative region. Worth mention, in the present embodiment, the first portion 111 and the second portion 112 are both of opaque portions. The opaque portions are light impermissible portions.

In detail, the first portion 111 and the second portion 112 can be, for example, made of opaque material. Thus, the first portion 111 and the second portion 112 can be integrally formed. Certainly, in one preferred embodiment, the outer element 110 has a outer surface S1 and a inner surface S2. The outer surface S1 can be, for example, formed with opaque material by attaching operation. Also, the outer surface S1 can be, for example, formed with opaque material by other appropriate operations. Wherein, the first portion 111 and the second portion 112 are provided with the foregoing opaque material. Similarly, in another preferred embodiment, the foregoing opaque material also can be formed on the inner surface S2 of the outer element 110, and the first portion 111 and the second portion 112 are provided with the opaque material of the inner surface S2. This means, in the present invention, the first portion 111 and the second portion 112 can be configured on at least one of the outer surface S1 and the inner surface S2.

In the present embodiment, at least one first through hole H1 is configured in each second portion 112. The second portion 112 of the present embodiment is exemplified by applying three first through holes H1 mainly. Wherein, each first through hole H1 can be, for example, inserted by each electrical pin or connecting terminal of a plug. In addition, the light indicating element 120 of the present embodiment has at least one lighting set 121. Each lighting set 121 is corresponding to each second portion 112. Besides, each lighting set 121 has at least one lighting unit 121*a*. The lighting set 121 of the present embodiment is exemplified by applying three lighting units 121*a* mainly. The foregoing lighting unit 121*a* is, for example, a light emitting diodes.

Worth mention, in the present embodiment, each lighting unit 121*a* is corresponding to configure in inner periphery of each first through hole H1 of each second portion 112. In other words, in the present embodiment, each lighting unit 121*a* can be exposed from the corresponding first through hole H1. In detail, in the present embodiment, the first through hole H1 is a prong-hole. Thus, the first through hole H1 is configured with a hole wall H11, and each lighting unit 121*a* is configured at the hole wall H11 of the first through hole H1. Therefore, each first through hole H1 can expose the corresponding lighting unit 121*a*.

Further, the light indicating element 120 of the present embodiment includes, for example, a board 122 and multiple second through holes H2. Wherein, the lighting set 121 is configured in the board 122. The second through holes H2 are corresponding to the first through holes H1 for being configured in the board 122. Briefly, in the present embodiment, projection area of each second through hole H2 projected on outer element 110 is overlapped with at least a part of the corresponding first through hole H1. In addition, in the present embodiment, each lighting unit 121*a* is configured around the corresponding second through hole H2. In detail, the lighting unit 121*a* of the present embodiment is, for example, a ring light emitting structure. The shape of the lighting unit 121*a* is, for example, similar to the shape of the first through hole H1. Thus, the lighting unit 121*a* of the present embodiment is protruded to the first through hole H1 from the board 122, and can be configured at the hole wall H11 of the first through hole H1 appropriately.

Therefore, when users want to use any electrical device in darkness room or an area of reduced visibility, the lighting unit 121*a* of the present embodiment can light directly from the position which being configured by the configuring design of the lighting unit 121*a*. Wherein, the configuring design is that the lighting unit 121*a* is configured in inner side edge of the first through hole H1 of the second portion 112 in the power outlet device 100 of the present embodiment. The light emitted from the lighting unit 121*a* will not be blocked by any object or shelter. In other words, the light emitted from the lighting unit 121*a* of the present embodiment is incident to the external environment directly without any light refraction, light reflection or light guidance. Thus, the present invention can provide a preferred identifying function for each first through hole (prong-hole) H1 or each second portion 112 (socket region). In other words, in darkness room or the area of reduced visibility, the power outlet device 100 of the present embodiment still can provide a preferred identifying function for users to determine the position of each socket unit or each prong-hole located in the outlet and then inserting the plug of electrical device therein. The configuring design of the lighting unit 121*a* also prevent the phenomenon of uneven brightness resulted from direct light and refracted light which being caused simultaneously. The phenomenon will cause user to feel uncomfortable, and position of the socket unit or each prong-hole located in the outlet also can not be determined effectively.

In one preferred embodiment, the outer element 110 further includes at least a third portion 113. Wherein, each third portion 113 is, for example, corresponding to each second portion 112. Further, in the present embodiment, each third portion 113 is configured around the corresponding second portion 112. In other words, the third portion 113 is configured between the first portion 111 and each second portion 112. Thus, projection area of each third portion 113 projected on the light indicating element 120 is around the corresponding lighting set 121. Worth mention, in the present embodiment, the third portion 113 is a light transmission portion. Thus, lights emitted from partial of the lighting units 121*a* or other inner lighting source can penetrate to external environment from the third portion 113 for increasing the identifying effect of the second portion 112 (socket region).

In particular, in one preferred embodiment, top portion of the lighting unit 121*a* is, for example, a slope structure S3. Wherein, the slope structure S3 is, for example, tilted toward the inner edge of the lighting unit 121*a* from the outer edge of the lighting unit 121*a*. Thus, when the plug of the electrical device is inserted into the second portion 112, each electrical pin or connecting terminal of the plug can be guided to the first through hole H1 effectively, and being further passed through the second through hole H2 and then couple to electrical connecting element (not shown) of the outlet module 130.

To sum up, in the present invention, the lighting unit is configured in inner side edge of the prong-hole (first through hole) of the socket region (second portion). Thus, the lighting unit of the present embodiment can light to external environment directly from the configuring position of the lighting unit for providing a preferred identifying effect of the prong-hole (first through hole) or socket region (second portion). Thus, the power outlet device of the present invention can provide a preferred identifying function for users to determine the position of the socket unit or each prong-hole located in the outlet, and then inserting the plug of electrical device therein.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A power outlet device, comprising:

a outer element, having a first portion and at least a second portion, the first portion is configured out of the second portion, at least one first through hole is configured in the second portion, wherein the first portion and the second portion are opaque portions;

a light indicating element, having at least one lighting set, each lighting set is corresponding to each second portion, each lighting set has at least one lighting unit, each lighting unit is configured in the inner periphery of each first through hole of the second portion; and a outlet module;

wherein, the light indicating element is configured on the outlet module, and the outer element is configured on the light indicating element;

wherein, each lighting unit is exposed from the corresponding first through hole.

2. The power outlet device according to claim 1, wherein the first through hole is a prong-hole, the first through hole is configured with a hole wall, and each lighting unit is configured at the hole wall of the first through hole.

3. The power outlet device according to claim 1, wherein the outlet module has a accommodation space, and the light indicating element is configured in the accommodation space.

4. The power outlet device according to claim 1, wherein the outer element further includes a outer surface and a inner surface, the first portion and the second portion are configured on at least one of the outer surface and the inner surface.

5. The power outlet device according to claim 1, wherein the light indicating element further includes a board and multiple second through holes, the lighting set is configured in the board, the second through holes are corresponding to the first through holes for being configured in the board, and each lighting unit is configured around the corresponding second through hole.

6. The power outlet device according to claim 5, wherein each lighting unit is protruded to the first through hole from the board.

7. The power outlet device according to claim 5, wherein the projection area of each second through hole projected on the outer element is overlapped with at least a part of the corresponding first through hole.

8. The power outlet device according to claim 1, wherein the outer element further includes at least a third portion, each third portion is corresponding to the second portion, each third portion is configured around the corresponding second portion, the third portion is a light transmission portion.

9. The power outlet device according to claim 8, wherein the third portion is configured between the first portion and each second portion.

10. The power outlet device according to claim 9, wherein the projection area of each third portion projected on the light indicating element is around the corresponding lighting set.

11. The power outlet device according to claim 1, wherein the second portion is a socket region, and the first portion is a decorative region.

12. The power outlet device according to claim 1, wherein the lighting unit is a light emitting diodes.

13. The power outlet device according to claim 1, wherein the lighting unit is a ring light emitting structure.

14. The power outlet device according to claim 1, wherein the shape of the lighting unit is similar to the shape of the first through hole.

15. The power outlet device according to claim 14, wherein top portion of the lighting unit is a slope structure, the slope structure is tilted toward the inner edge of the lighting unit from the outer edge of the lighting unit.

* * * * *